United States Patent [19]

Dial

[11] 4,139,117

[45] Feb. 13, 1979

[54] FLOATING COVER ASSEMBLY

[76] Inventor: Howard S. Dial, 601 Jefferson, Houston, Tex. 77002

[21] Appl. No.: 728,139

[22] Filed: Sep. 30, 1976

[51] Int. Cl.[2] ..... B65D 87/18; E04H 3/16

[52] U.S. Cl. ..... 220/218; 4/172.12; 220/221; 220/225

[58] Field of Search ..... 220/216–227, 220/228; 61/0.5; 4/172.12, 172.13, 172.14

[56] References Cited

U.S. PATENT DOCUMENTS

| | | | |
|---|---|---|---|
| 2,497,850 | 2/1950 | Allen | 220/225 |
| 2,883,676 | 4/1959 | Kwake | 4/172.12 |
| 3,313,443 | 4/1967 | Dial et al. | 220/219 |
| 3,330,118 | 7/1967 | Biais | 220/225 X |
| 3,533,110 | 10/1970 | Gisondi | 4/172.12 |
| 3,676,880 | 7/1972 | Kwake | 4/172.12 |
| 3,747,131 | 7/1973 | Koliomichalis | 4/172.12 |
| 3,991,900 | 11/1976 | Burke et al. | 220/219 |
| 4,048,678 | 9/1977 | Chillino | 4/172.12 |

*Primary Examiner*—Herbert F. Ross

[57] ABSTRACT

A floating cover assembly encompassing in a first condition a method and apparatus for tensioning a floating cover for a liquid storage reservoir wherein the surface level of the stored liquid varies and in a second condition, a method and apparatus for maintaining a liquid storage reservoir. In the apparatus of the above inventions, a peripheral envelope formed at least adjacent a portion of the peripheral edges of the floatable sheet is adapted to be inflated with a compressible fluid, such as air, for proper tensioning of the sheet as the level of the stored liquid varies in the reservoir and for preventing wrinkling of the sheet while, in the second condition, the peripheral envelope is adapted to be filled with a non-compressible fluid for providing a ballast for the sheet during maintenance operations thereof while the sheet is inflatably supported for maintenance of the sheet and/or reservoir.

21 Claims, 11 Drawing Figures

FLOATING COVER ASSEMBLY

BACKGROUND OF THE INVENTION

The present invention relates generally to floating covers, particularly of the type to be used over large reservoirs.

Floating covers for contained fluids, generally speaking, are well known in the prior art. Some of this art is directed towards fluids contained within a tank or vessel rather than a fluid to be contained in a reservoir. Numerous patents such as U.S. Pat. Nos. 3,228,702; 1,775,758; 1,712,321; 3,343,708; 3,016,814 are directed towards providing seals for floating coverings that engage the sides of a suitable tank. Similarly, U.S. Pat. Nos. 3,159,301 and 3,557,994 are directed towards floating diaphragms adapted to be used in various pressure tanks. Other non-floating types of diaphragm covers for tanks are disclosed in U.S. Pat. Nos. 1,917,623 and 3,028,040. However, all of such prior art is directed towards floating structures that are contained within a substantially enclosed housing such as a tank or vessel. Such floating covers are not exposed to the adverse environmental conditions such as wind, ice and water accumulations on the surfaces thereof as well as the problems incumbent in providing floating sturctures for large expansive reservoirs rather than comparatively small storage tanks.

Floating covers, such as disclosed in U.S. Pat. Nos. 3,462,040; 3,592,009; and, 3,740,902, have long been in use. However, a recurring problem that has plagued reservoir covers of the prior art is how to control the tension of the floating cover on the fluid while accommodating fluid elevational changes in a reservoir having sloping or tapered surfaces adjacent reservoir peripheries. In U.S. Pat. Nos. 2,986,302 and 3,079,030, movable segmented sections are used to support the floating cover as the fluid level experiences elevational variations. U.S. Pat. No. 3,330,118 discloses the use of a plurality of circular floaters for supporting the cover of a sunken tank as the fluid varies in elevation while U.S. Pat. No. 2,970,716 uses multiple sections in combination with pontoons to support the floating roof for an oil storage reservoir.

U.S. Pat. No. 3,815,367 discloses the use of a complex tensioning line-arrangement for providing for the proper tension of a floating cover assembly for a reservoir to insure biasing thereof. Further, the present inventor disclosed in U.S. Pat. Nos. 3,313,443 and 3,667,641 floating cover arrangements which provide for a variety of drain configurations to prevent unwanted accumulation of liquid on the upper surface of such a liquid storage reservoir cover in an effort to prevent damage due to the weight of unwanted liquid on the upper surface of the cover and/or the detrimental environmental effects due to freezing and the like. Further, U.S. Pat. No. 3,736,754 discloses a combination two-cover assembly wherein one cover is used to float on the surface of the stored liquid while another roof is inflated thereover for protection of the floating roof. This dual roof assembly not only is expensive but requires maintenance on both the floating cover as well as the inflatable roof.

Not only is it important that a floating cover have the proper tension thereon to prevent damage thereto as a result of high wind and/or water accumulations thereon, but also it is important to provide for ease in reservoir maintenance thereof without necessitating removal of the cover. Typically, prior art repairs and other reservoir maintenance was accomplished by divers submerged in the reservoir fluid below the reservoir cover. However, no provisions are made in the prior art for providing an effective system of maintenance and repair of both the floating cover as well as the storage reservoir in combination with means for compensating for elevational changes of the fluid within the reservoir while providing the necessary tension on the reservoir cover.

Also, in the prior art, flexible and/or inflatable structures have been used for a wide variety of applications which include use in a variety of shelter or building configurations such as those disclosed in U.S. Pat. Nos. 3,924,363; 3,626,836; and 3,885,360 as well as an inflatable covering for swimming pools as disclosed in U.S. Pat. No. 3,918,221 and collapsible dams and damming methods as disclosed in U.S. Pat. No. 3,834,167.

Although these relate generally to inflatable structures, these are of little consequence in considering the requirements that must be met by a reservoir cover that must not only float on the surface of the reservoir fluid having a required tensioning thereof but also have appropriate provisions for ease in reservoir or cover maintenance.

SUMMARY OF THE INVENTION

The present invention relates to a new and improved floating cover assembly encompassing both methods and apparatuses for tensioning as well as maintaining a floating cover and a liquid storage reservoir wherein the surface level of the stored liquid varies. In a first embodiment, including a method and apparatus for tensioning the floating cover, the apparatus includes a flexible sheet adapted to be floated on the surface of the stored liquid. The sheet is formed having envelope means adjacent at least a portion of the peripheral edge thereof and adapted to be filled with a compressible fluid for tensioning the sheet to eliminate the formation of wrinkles in the sheet when floating on the surface of the level-varying liquid stored in the reservoir. In a second embodiment, including a method and apparatus for maintaining a liquid storage reservoir, the apparatus includes a sheet adapted to float on the surface of the stored liquid having envelop means formed with the sheet at least adjacent a portion of the peripheral edge thereof and adapted to be filled with a non-compressible fluid for ballasting the sheet during maintenance operations thereof and in conjunction with blower means operatively communicating with a chamber formed between the sheet and the storage reservoir for inflating the sheet to enhance ease of maintenance of the sheet and cleanout of the storage reservoir.

DESCRIPTION OF THE PREFERRED EMBODIMENT

Figure 1:
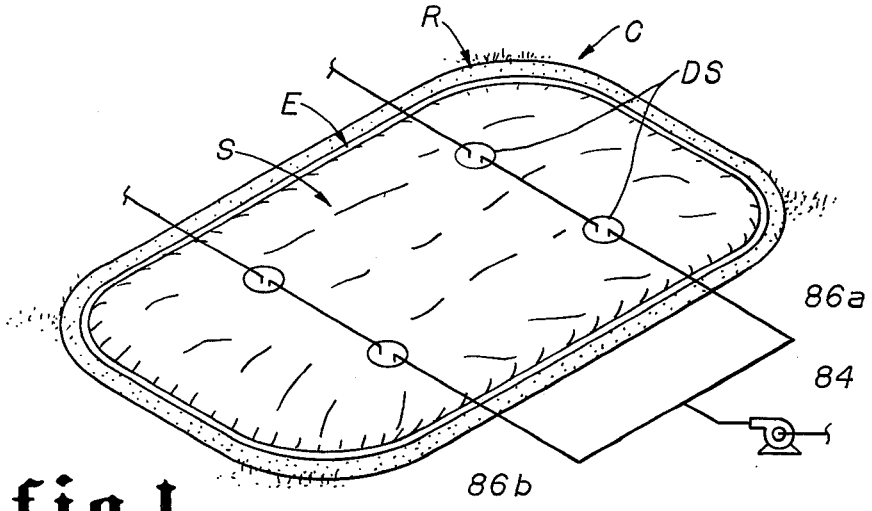
FIG. 1 is an isometric view of the floating cover assembly of the preferred embodiment of this invention.

Referring to the drawings, the letter C designates the floating cover assembly of the present invention. The floating cover assembly C includes a sheet S adapted to be secured to a reservoir R by securing means M with the sheet S having envelope means E formed therewith for covering the liquid storage reservoir R.

Figure 3:
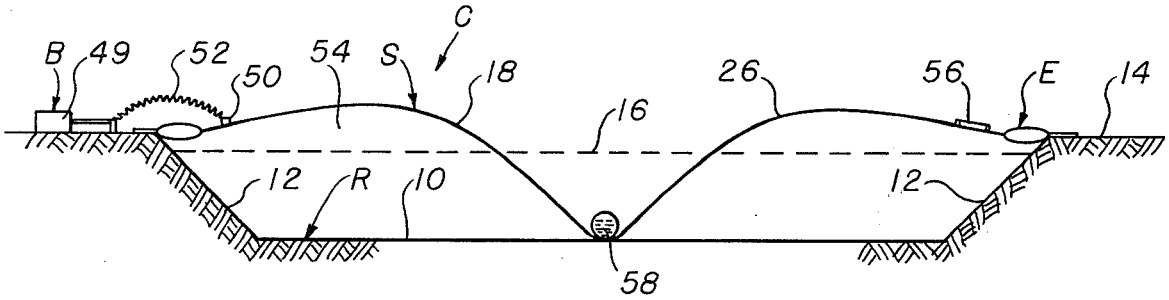
FIG. 3 is a schematic elevational view of the liquid storage reservoir having the floating cover assembly of one embodiment of the present invention therewith for maintenance of the sheet and/or reservoir.
Figure 4:
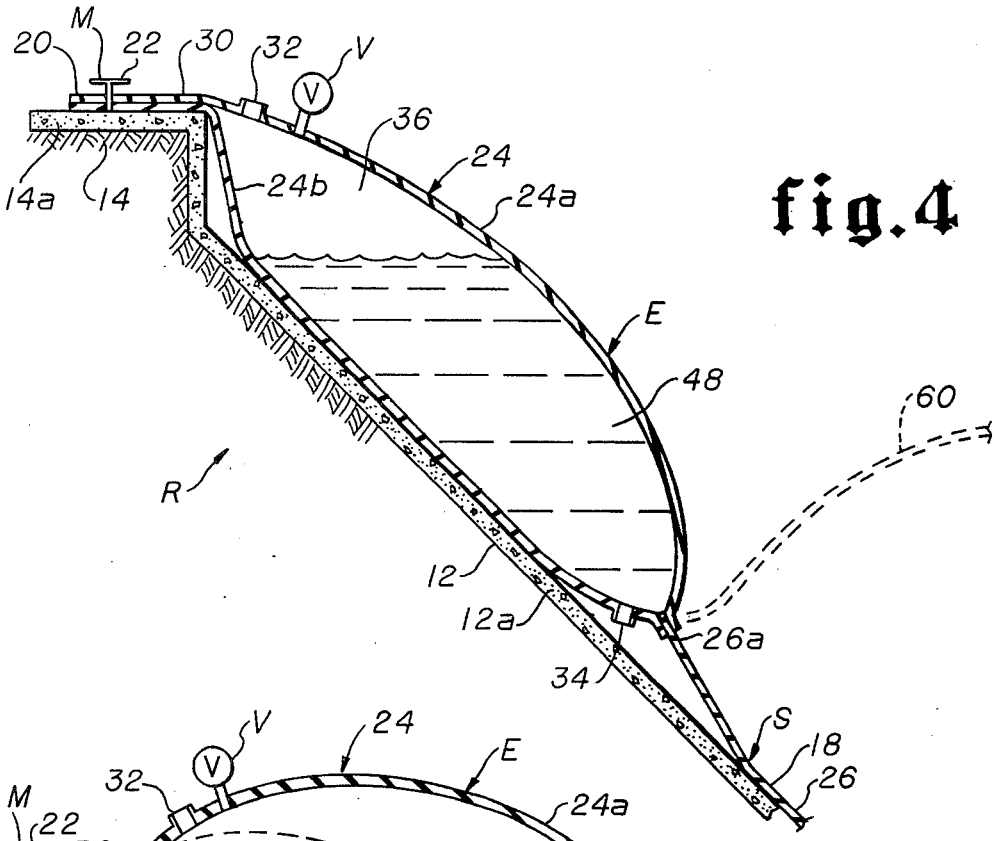
FIG. 4 is an elevational view of the floating cover assembly of the present invention showing ballasting of the sheet during maintenance operations.
Figure 5:
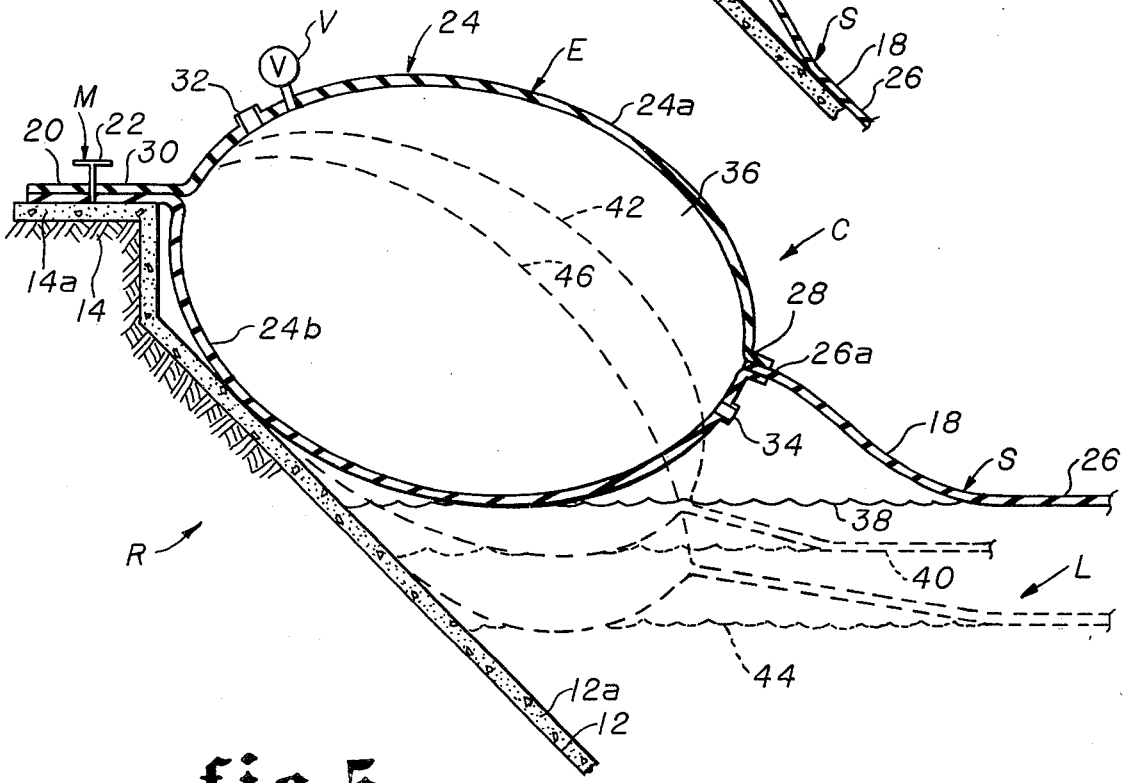
FIG. 5 is an elevational view of the floating cover assembly of the present invention, showing tensioning of the sheet to eliminate formation of wrinkles in the sheet when floating on the surface of the level-varying liquid stored in the reservoir.
Figure 6:
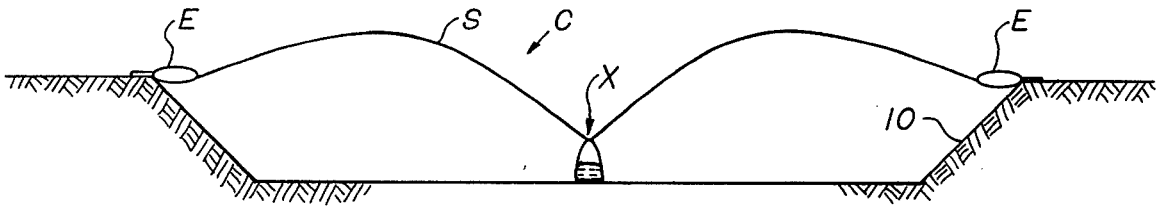
FIG. 6 is an elevational view showing plural envelope means of the floating cover assembly of the present invention.

The floating cover assembly C of the present invention is adapted to be used in conjunction with a liquid storage reservoir R. Such liquid storage reservoirs R are well known in the art and may be of a variety of sizes and shapes as well as types of construction. As shown schematically in FIG. 3, the reservoir R may be formed of an excavated portion of a tract of land such that the reservoir R includes a reservoir floor 10, side walls 12 and berm 14. Although the sides walls 12 are illustrated as being inclined, they may be arranged vertically or otherwise formed as desired. The reservoir floor 10, side walls 12 and berm 14 may be formed of earth as shown in FIG. 3 or may have concrete wrappers 10*a*, 12*a*, 14*a*, respectively (FIGS. 4, 5). Alternatively, the wrappers 10*a*, 12*a*, 14*a* may be of metal or any other suitable material. The reservoir floor 10 will ordinarily be flat as shown in FIG. 3 and additionally, the inner surface of the reservoir may be lined with suitable fluid-impervious material such as a liner (not shown) formed of a flexible sheet material such as a rubber-coated fabric, multi-ply butyl rubber, nylon, polyvinyl chloride, or the like.

The liquid L to be stored in the liquid storage reservoir R may be supplied to and withdrawn from the reservoir R by any suitable or conventional means (not shown) and will normally be maintained at a predetermined level no greater than the maximum level 16 (FIG. 3). The predetermined level may vary as described more fully hereinbelow. Such normal level variations will, of course, be determined by the anticipated supply and removal of the stored liquid L for which the reservoir R is provided and may differ in every installation.

Figure 2:
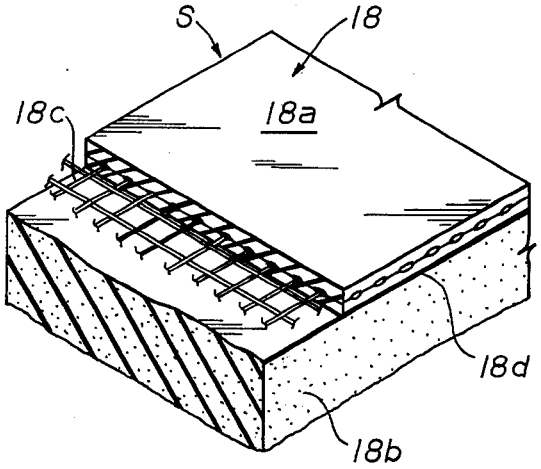
FIG. 2 is an isometric, sectional view of the sheet adapted to float on the surface of the stored liquid of the liquid storage reservoir, of the floating cover assembly of the present invention.

The cover assembly C of the present invention includes a sheet S. The sheet S is preferably formed of a flexible material which is impervious to the stored liquid L and will not be attacked by nor deteriorate in the presence of the stored liquid L in the reservoir R. Further, it is desired that the sheet S be adapted to float on the surface of the stored liquid L. Preferably, the sheet S may be formed of a laminated rubber or plastic cover material 18 as shown in FIG. 2. The laminated cover material 18 is preferably formed of an upper layer 18*a* and a lower layer 18*b* mounted therewith and which may be formed of different rubber or plastic materials. Preferably, the upper layer 18*a* is adapted to be exposed to the adverse environmental conditions surrounding the reservoir R, such as rain, wind, ice, heat and the like without deterioration thereof. Preferably, the upper layer 18*a* is formed of a material such as that sold under the trademark "Hypalon", by the Dupont Company, further having a reinforcement filament 18*c* formed of polyester to add strength to the upper layer 18*a*. Preferably, the lower layer 18*b* is formed of a closed cell polyethylene foam with the lower layer 18*b* being laminated to upper layer 18*a* at interface 18*d*. As such, the lower layer 18*b* acts to floatably support itself as well as the upper layer 18*a* on the stored liquid L within the reservoir R. Typically, the stored liquid L is water, howver, the reservoir R may contain oil, hydrocarbons or other liquids and consequently, the sheet S must be appropriately formed of a material that is not only impervious to the stored liquid L but also will float on such liquid.

The floating roof material 18 is selected and designed to be inflated as well as to float. The material must also be lightweight to balloon when inflated with a relatively low air pressure in the range of 1–3 lbs. per square foot. The continuous form layer will prevent a section of the roof to sink if the material 18 is inadvertently punchured and will also serve to insulate the water in the reservoir from undesired extremes of cold and heat.

The sheet S includes a peripheral edge 20 adapted to be secured to the berm 14 of the reservoir R by securing means M. The securing means M may include an appropriate cleat or fastener 22 which may be embedded in the concrete wrapper 14*a* of the berm 14 for securing the sheet S thereto adjacent the peripheral edge 20 thereof. The sheet S for the reservoir R should have an area which is greater than the area of the reservoir R where the securing means M for the sheet S are located.

The floatable cover assembly C of the present invention further includes envelope means E formed with the sheet S at least adjacent a portion of the peripheral edge 20 and preferably of the cover material 18. The envelope means E includes envelope 24 formed of an upper portion 24*a* and a lower portion 24*b* which preferably is formed of the same material as the laminated cover material 18. The envelope means E is preferably located adjacent the berm 14 of the reservoir R therebetween the peripheral edge 20 of the sheet S and the interior cover portion 26 at the marginal edge 26*a* thereof. It should be recognized that if there should be a portion of the sheet S not having an envelope means E therewith, then the marginal edge 26*a* of the sheet S will act as the peripheral edge 20 to be secured to the berm 14 and fasteners 22 therewith. Alternatively, if the envelope means E is in fact therebetween the marginal edge 26*a* of the interior cover portion 26 and the peripheral edge 20, then the envelop means E will preferably be formed as shown in FIGS. 4 and 5 of portions 24*a*, 24*b*. The upper portion 24*a* and lower portion 24*b* are appropriately affixed or bonded to the marginal edge 26*a* in fluid-tight engagement adjacent the bonding edge schematically represented at 28 (FIGS. 4, 5). Similarly, upper portion 24*a* and lower portion 24*b* of envelope 24 are bonded or suitably affixed theretogether in fluid-tight engagement adjacent the peripheral edge 20 at schematic location 30.

The envelope means E is further formed having at least one inlet port 32 and at least one outlet port 34. The ports 32, 34 are adapted to be opened and closed and in the closed position, provide a fluid-tight seal with the interior portion 36 of the envelope means E.

Valve means V is mounted with envelope means E preferably adjacent inlet port 32 in communication with the interior portion 36 of the envelope means E. The valve means V acts to regulate the amount of compressible fluid within the envelope means E as discussed more fully hereinbelow.

In the use or operation of one form of the cover assembly C of the present invention, the cover assembly C is to provide for proper tensioning of the floating sheet S wherein the surface level of the stored liquid in the liquid storage reservoir R varies. The sheet S is disposed on the stored liquid L in the reservoir R with the peripheral edge 20 being secured to the beam 14 of the reservoir R by securing means M and having envelope means E therewith at least adjacent a portion of the peripheral edge 20 of the sheet S. The envelope means E is adapted to be filled with a compressible fluid such as air, or any suitable gas, for expanding the envelope means E as shown in FIG. 5. The expansion or ballooning action of the envelop means E contracts the sheet S resulting in tensioning of the interior cover portion 26 to eliminate the formation of wrinkles in the sheet S when floating on the surface of the level-varying liquid stored in the reservoir R. Thus, the envelope means E is expanded in balloon-like fashion to result in a lateral tensioning force on the sheet S tending to stretch the sheet S outwardly whereby wrinkles and cavities in the surface of the sheet S will be reduced facilitating flow of rain and water from melting snow off of the sheet S towards an appropriate drain during adverse environmental conditions while also preventing pooling of fluid on the exterior surface thereof. The prevention of wrinkles results in facilitating the removal of any accumulation and retained liquid on the surface of the sheet S which helps facilitate the reduction of stresses and strains on the laminated cover material 18.

The envelope means E is inflated to a desired amount to insure such proper, lateral tensioning of the sheet S to eliminate the formation of wrinkles in the sheet S when floating on the surface of the stored liquid L in the reservoir R. As the liquid level varies, it may be necessary to add or remove compressible fluid from within the envelope means E. As shown in FIG. 5, the envelop means E is at a high level of stored liquid L as indicated at position 38. Should the stored liquid L level drop to that such as indicated as position 40, additional lateral tension is effectuated upon the sheet S. This increased lateral tension tends to flatten the envelope means E therefore increasing the pressure of the compressible fluid within the interior portion 36 of the envelope means E. Should this pressure increase overcome a predetermined pressure release setting within the valve means V, the valve means V acts to release the excess pressure in a "pop-off" valve fashion to effectuate release of such excess pressure build-upswithin the envelope means E, but only reducing the pressure within the interior portion 36 to that of the predetermined amount.

Thus, with the envelope means E in a position such as that designated at 42 on stored liquid level indicated at 40, the internal pressure within the interior portion 36 is substantially the same as that of the envelope means E as positioned at the high level stored liquid position 38, while retaining substantially the same tensioning on the sheet S. This results in the sheet S being of substantially a uniform tension while the liquid level of the stored liquid in the reservoir R is of a changing nature.

Similarly, should the stored liquid L fall to a position indicated at level 44, the tension on the sheet S increases, further compressing the interior portion 36 of the envelope means E to such a position as noted at 46 wherein the valve means V again vents the excess pressure within the interior portion 36 such that the appropriate compressible fluid pressure within the envelope means E remains substantially the same to insure a proper tensioning of the sheet S as the liquid continues to vary. Should the liquid level rise from that of level 44 to that of level 40, it would be necessary to add or increase the amount of compressible fluid within the envelope means E by supplying such through inlet port 32 in an appropriate fashion to thereagain assure proper tensioning of the sheet S.

Further, it should be noted that the sheet S may have plural envelope E about the peripheral edge thereof, for sheets S having extremely large surface areas and where one envelope means E is not sufficient to provide the proper tensioning of such a sheet S.

The cover assembly C of the present invention may be effectively incorporated for properly maintaining the liquid storage reservoir R and sheet S for maintenance thereof should the reservoir R and/or sheet S require maintenance thereof. During such a maintenance operation, it is preferred that the reservoir R be drained of stored liquid L by any appropriate conventional means (not shown). Thereafter, the envelope means E, as shown in FIG. 4, is appropriately filled through inlet port 32 with any suitable non-compressible fluid 48 such as water, or any other desired fluid resulting in the envelope means E resting upon the concrete wrapping 12*a* of side walls 12 due to the weight of the fluid 48 within the envelope means E. Thereafter, blower means B, which may be of any suitable high-capacity blower 49 or the like, is connected with the sheet S by port 50 and flexible hose 52 therebetween such port 50 and the blower means B. The blower B is appropriately energized resulting in the movement of compressible fluid, such as air, from the blower means B under pressure through the flexible hose 52 into port 50 and thereinto a cavity 54 formed therebetween the reservoir R and the lower surface of the sheet S, resulting in inflation of the sheet S which is heretofore unsupported due to the stored liquid having been drained. The blower means B results in the sheet S being inflated to permit inspection and repair of the sheet S and cleanout of the storage reservoir R. The envelope means E being filled with non-compressible fluid 48 acts as a ballast about the peripheral edge 20 of the sheet S to prevent the sheet S from flapping in an unwielding fashion which could damage, tear, rupture and/or destroy the sheet S while being in such an inflatably supported position. It is desired that the sheet S be at substantially the same elevation as the berm 14 of the reservoir R to prevent any undue wind damage to the sheet S during such maintenance operations. The reservoir R and the lower surface of the sheet S may be accessed by an appropriate access hatch mounted with the sheet S. Thus, the sheet S and reservoir R may be duly inspected, repaired or otherwise maintained without the need of divers or other aquatic gear which has heretobefore been the maintenance procedure of the prior art.

Should the sheet S be of a significantly expansive size, it may be necessary to provide one or more intermediate ballasts 58 to prevent the sheet S from extending significantly thereabove the berm 14 of the reservoir R which could cause wind damage to the sheet S. The intermediate ballast 58 may include one or more ballast arrangements of any suitable size, shape and/or weight in order that the sheet S may be kept substantially the same as that of the elevation of the berm 14 of the reservoir R. The intermediate ballast 58 is preferably of a plastic tube adapted to be filled with fluid such as water so that the ballast may be positioned, then filled with water during maintenance operations, and thereafter be drained to eliminate the need in moving heavy intermediate ballasts 58 about the sheet S prior to positioning same for proper maintenance operations.

The envelops E as filled with fluid 48 help to keep a proper tensioning of the sheet S while being supported by the fluid pressure generated by the blower means B and help to prevent damage to the sheet S in its expanded, inflatably supported configuration. For example, the sheet S as shown in FIG. 4, upon draining of the reservoir R, results in the sheet overlying the concrete wrapping 12*a* of the sloping sides 12 of the reservoir R whereinafter being inflated, the sheet S moves to a position such as that indicated by dotted lines at position 60 or in such a configuration as schematically shown in FIG. 3. Thus, the cover assembly C of the present invention provides for a method and apparatus for properly maintaining the reservoir R and sheet S during the maintenance operations thereof. After maintenance operations have been completed, preferably, the blower means B is removed and the non-compressible fluid 48 is drained from the envelope means E by means of outlet port 34 being released and/or the fluid 48 being pumped outwardly from the interior portion 36 of the envelope means E through the inlet port 32 and outwardly therefrom. Thereafter, the reservoir R is preferably again filled with liquid to be stored therein and the sheet S is thereafter tensioned by inflating the envelope means E of the sheet S with a compressible fluid to thereafter tension the sheet S as it floatably overlies the stored liquid L in accordance with the hereinabove described procedures to prevent the formation of wrinkles on the sheet S for protecting the same.

Thus, the cover assembly C of the present invention provides not only the means and method for appropriately tensioning a sheet S on the stored liquid L of a storage reservoir R but also provides for ease of access, maintenance and repair of the sheet S and reservoir R during maintenance operations thereof.

Figure 7:
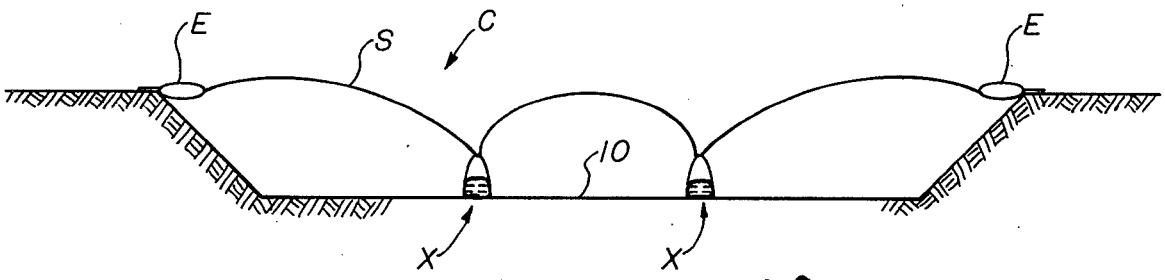
FIG. 7 is a view similar to FIG. 6 and illustrating a plurality of ballasted pneumatic support columns.
Figure 9:
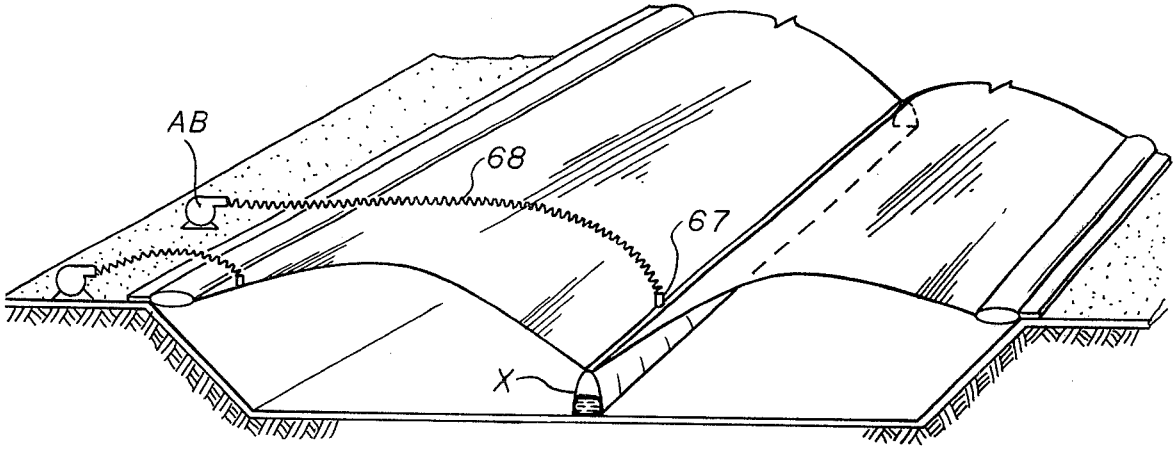
FIG. 9 is an isometric view of the floating cover of the present invention in the inflated condition.

Modified foam cover assembly of the present invention is illustrated as in FIG. 9 having a single center ballast pneumatic support column, generally designated X for both supporting and ballasting the sheet S when the cover assembly C-1 is in the inflated condition as illustrated. Another modified cover assembly C-2 is illustrated in FIG. 7 having a plurality of the ballasted pneumatic support columns X.

Figure 8:
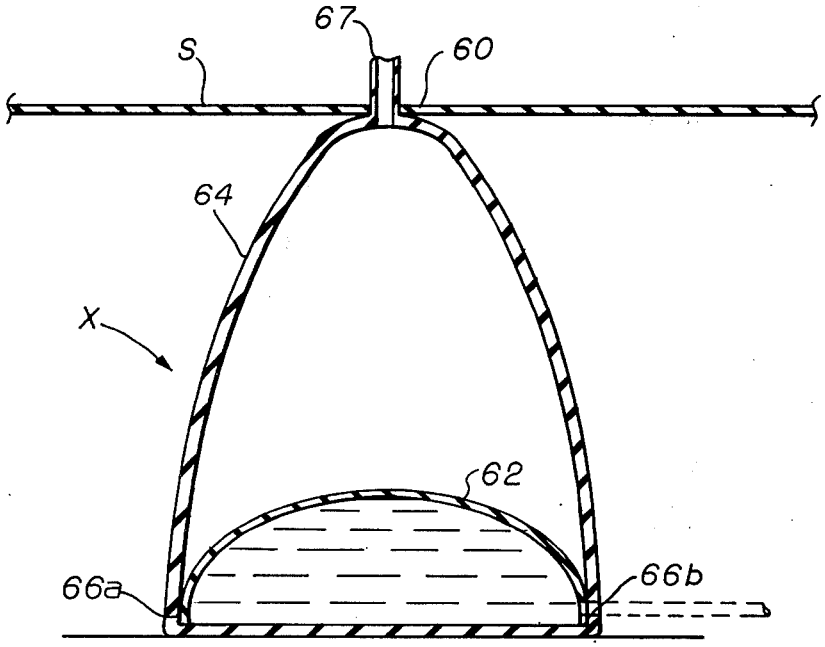
FIG. 8 is a sectional side view of the ballasted pneumatic support column.

As best illustrated in FIG. 8, the ballasted pneumatic support column X is secured to the underside of the sheet at 60. The support column X may be secured by sewing, glueing or the like and as illustrated in FIG. 9 extends substantially across the reservoir R.

The pneumatic support column X includes a lower enclosed ballast chamber 62 and an upper pneumatic chamber 64. The lower or ballast chamber 62 is formed of a material impervious to water and preferably extends beyond the ends of the upper chamber 64 a short distance for a purpose to be described hereinafter. The upper chamber 64 is also formed of a flexible material and in addition to being secured with the roof S at 10 is secured on opposite sides of the lower tubular reservoir 62 at 66*a* and 66*b*. The flexible material 64 is preferably formed with a foam flotation characteristic in order that the sheet 64 will float adjacent the sheet S when the pneumatic support column is in the inoperative condition and the reservoir R is full of water. Suitable connections 67 are provided for communicating with a supply of air to an auxiliary blower AB as illustrated in FIG. 9. With the ends of the chamber closed pneumatic pressure in the support column X will be greater than that under the roof S and will tend to provide a support column at that point on the sheet S. The water ballast in the lower chamber will of course prevent the lifting of the sheet S and the pneumatic support column X from the floor 10 of the reservoir R.

It will be apparent to those skilled in the art that other means than those illustrated herein may be used to ballast the cover. For instance, the ballast chamber 62 may be attached to the cover by flexible lines or a single sheet of material which will enable the cover to inflate sufficiently to provide adequate worker access to the reservoir.

As mentioned previously the enclosed ends of the lower ballast chamber protrude slightly beyond the pneumatic support column chamber 64. This is done to provide access to the ballast chamber 62 for controlling the filling of the ballast. When the roof is in the normal operating condition floating on the liquid reservoir the form cover 64 will pull the opening in the top of the ballast chamber 62 extending beyond the chamber 64 adjacent the sheet S. A zippered opening or access port in the sheet S is provided adjacent this fill point and when it is desired to maintain the reservoir using the pneumatic column X these access ports to be closed to contain the water normally present therein when the reservoir R is drained of the liquid L. When the sheet S is in the floating condition these ports are left open and the water is left free to flow in and out of the ballast chamber 62.

To prevent an undesired accumulation of rain water and the like on the upper side of the cover one or more drain sumps DS may be provided as illustrated in 51. The drain sumps DS provide a gathering spot for the rainwater as well as providing for the elimination of the rainwater from the top of the cover where it could possibly contaminate the liquid L in the reservoir R.

Figure 10:
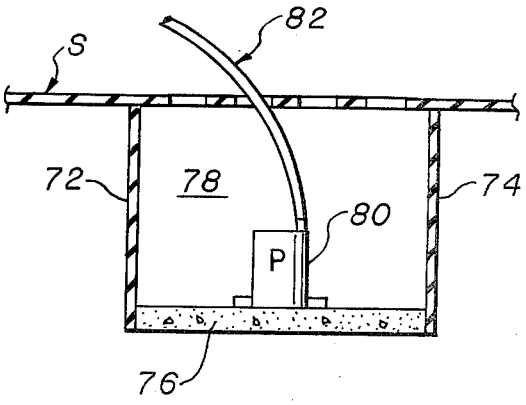
FIG. 10 is a sectional side view of a drain sump of the floating cover of the present invention.

The drain sump DS as best illustrated in FIG. 10 is provided with sides 72 and 74 made of impervious flexible material. The bottom or floor 76 of the drain sump DS is also made of impervious material and is peferably ballasted to hold the bottom 76 in a position below the sheet S in order that the water will drain into the pocket 78 formed by the drain sump DS.

To remove the rainwater from the pocket 78 of the drain sump DS a pump 80 may be positioned in the pocket 78 to remove the water preferably a submersible type electrically driven pump is used with electrical connection 82 being connected to a source of electrical power. Also, jet pumps or eductors may be employed as illustrated in FIG. 1.

In FIG. 1 a source of fluid under pressure is provided such as by pump 84 is separated into two flowlines 86*a* and 86*b*.

Figure 11:
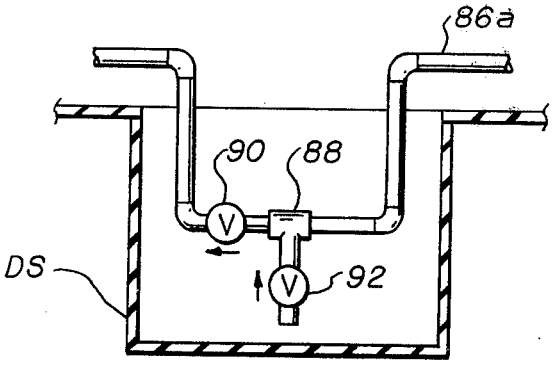
FIG. 11 is a sectional side view of another form of drain sump.

As illustrated in FIG. 11 the conduit 86*a* extends outwardly on the cover S until it reaches drain sump DS. An eductors or jet pump is connected into conduit 86*a* in the drain sump DS. The eductors 88 discharge may then be run to the edge of the reservoir to a discharge location or it may be run to another drain sump as illustrated in FIG. 1. The eductors 88 is provided with a suitable backflow valve 90 in the conduit 86*a* and a foot valve 92 on the inlet of the eductors 88 for the fluid to be evacuated from the drain sump DS. Such arrangement of using a jet pump is old and well known to those skilled in the art.

The foregoing disclosure and description of the invention are illustrative and explanatory thereof, and various changes in the size, shape and materials as well as in the details of the illustrated construction may be made without departing from the spirit of the invention.

I claim:

1. A floating cover assembly for a liquid storage reservoir where the surface level of the stored liquid varies, said assembly comprising:

a sheet of flexible material having a marginal edge, said sheet being impervious to the liquid stored in the reservoir and floatable on the surface of the stored liquid for preventing contamination of the stored liquid; and envelope means attached to the marginal edges of said sheet, means for securing said envelope means to the berm of said reservoir, said envelope means adapted to be filled with a regulated amount of a compressible fluid to tension said sheet sufficiently to eliminate wrinkles in said floating flexible sheet as the surface of the level-varying liquid stored in the reservoir changes level relative to the berm of said reservoir.

2. The floating cover assembly of claim 1, further including:

valve means in communication with said envelope means for regulating the amount of compressible fluid in said envelope means as the level of the stored liquid in the reservoir varies for proper tensioning of said sheet.

3. The floating cover assembly of claim 1, wherein:

said envelope means include plural peripheral envelope adjacent one another for tensioning said sheet to eliminate the formation of wrinkles on said sheet.

4. A method for tensioning a flexible floating cover for a liquid storage reservoir where the surface level of the stored liquid varies relative to the berm of the reservoir to substantially eliminate wrinkling of the flexible cover, comprising the steps of:

disposing a sheet of flexible, floatable material on the liquid stored in the reservoir with the sheet having a marginal edge having envelope means attached to said marginal edge;

means for securing said envelope means to the berm of said reservoir;

inflating the envelope means with a regulated amount of compressible fluid to tension the sheet to prevent the formation of wrinkles in the floating sheet as the level of the stored liquid in the reservoir varies relative to the berm of the reservoir.

5. The method of claim 4, further including the step of:

regulating the tension of the sheet as the level of the stored liquid varies by valve means in communication with the envelope means.

6. A floating cover assembly for a liquid storage reservoir where the surface level of the stored liquid varies relative to the berm of the reservoir, said assembly comprising:

a sheet of flexible material having a marginal edge, said sheet being substantially impervious to the liquid stored in the reservoir and floatable on the surface of the stored liquid for preventing contamination of the stored liquid;

envelope means attached to the marginal edge of said floatable sheet, means for securing said envelope means to the berm of said reservoir, said envelope means adapted to be filled with a regulated amount of a compressible fluid to tension said sheet sufficiently to eliminate wrinkles in said floating flexible sheet as the surface of the level-varying liquid stored in the reservoir changes levels relative to the berm of the reservoir;

said envelope means adapted to be filled with a non-compressible fluid for ballasting said flexible sheet when the reservoir is emptied of stored liquid during maintenance operations; and, blower means operatively communicating with a chamber formed between said sheet and the emptied storage reservoir for inflating said floatable sheet resting on the reservoir to enhance access for ease of maintenance to the emptied storage reservoir below the flexible cover.

7. The floating cover assembly of claim 6, further including:

access means mounted with said sheet for providing access for maintenance personnel to said chamber during maintenance operations.

8. The floating cover assembly of claim 6, further including:

intermediate ballast means adapted to be disposed on said sheet independent of said envelope means during maintenance operations for preventing wind damage to said sheet when said sheet is inflated.

9. A method for maintaining a liquid storage reservoir having a floating flexible cover, comprising the steps of:

substantially emptying the stored liquid from the reservoir having the floating impervious flexible cover thereon for forming a substantially enclosed empty chamber between the storage reservoir and the floatable cover;

filling an envelope means attached to the marginal edge of said cover with a non-compressible fluid for providing ballast for the floatable flexible cover; and, inflating the substantially enclosed chamber formed between the storage reservoir and the floatable flexible cover with a regulated amount of compressible fluid by use of blower means in communication with the chamber to enable access to the substantially enclosed chamber for inspection and repair of the storage reservoir below the cover.

10. The method of claim 9, further including the step of:

disposing intermediate ballast means on the central portions of the sheet to prevent wind damage to the sheet while in the inflated position.

11. The method of claim 9, further including the step of:

accessing the chamber through access means mounted with the sheet for inspection and repair of the sheet and storage reservoir by the maintenance personnel.

12. The method of claim 9, further including the steps of:

removing the blower means after maintenance operations have been completed;

draining the non-compressible fluid from the envelop means of the sheet;

filling the reservoir with stored liquid; and, tensioning the sheet by inflating the envelope means of the sheet with a compressible fluid to prevent the formation of wrinkles on the sheet.

13. The method as set forth in claim 9, including the step of:

filling a ballast chamber secured to the floatable sheet with liquid prior to draining the liquid from the reservoir.

14. The method as set forth in claim 13, including the step of:

pressuring an enclosed chamber secured to the floatable sheet and the ballast chamber to provide a support column for the floatable sheet.

15. The method as set forth in claim 13, including the step of:

securing the ballast chamber to the floatable sheet with an intermediate member to enable the floatable cover to be inflated to a desired level above the ballast chamber.

16. A floating cover assembly for a liquid storage reservoir where the surface level of the stored liquid varies relative to the berm of said reservoir and which cover assembly rests smoothly upon the reservoir when emptied of liquid, said assembly comprising:

a sheet of flexible material having a marginal edge, said sheet being impervious to the liquid stored in the reservoir and floatable on the surface of the stored liquid for preventing contamination of the stored liquid;

means for securing said marginal edge of said flexible sheet with the berm of said reservoir;

said sheet of floatable flexible material disposed for resting wrinkle-free on the storage reservoir when emptied of liquid; and blower means operatively communicating with a chamber formed between said sheet and the emptied storage reservoir for inflating said flexible sheet with a regulated amount of air to provide worker access to the storage reservoir below said flexible sheet for maintenance operations.

17. The floating cover assembly of claim 16, further including:

access means mounted with said sheet for providing access for maintenance personnel to said chamber below said sheet during maintenance operations.

18. The floating cover assembly of claim 16, further including:

ballast means adapted to be disposed on said sheet during maintenance operations for preventing wind damage to said sheet when said sheet is inflated.

19. A method for maintaining a liquid storage reservoir having a floating flexible cover, comprising the steps of:

substantially draining the stored liquid from the reservoir having the floatable flexible cover thereon for forming a substantially enclosed empty chamber between the storage reservoir and the cover;

providing hold down ballast at desired locations for the cover to prevent wind damage to the cover while in the inflated condition; and inflating the substantially enclosed chamber formed between the storage reservoir and the sheet with a regulated amount of compressible fluid by use of a blower means in communication with the chamber to enable access to the substantially enclosed chamber below the cover for maintenance of the storage reservoir.

20. The method of claim 19, further including the step of:

accessing the chamber through access means mounted with the sheet for inspection and repair of the sheet and storage reservoir by the maintenance personnel.

21. The method of claim 19, further including the steps of:

removing the blower means after maintenance operations have been completed;

removing the hold down ballast from the sheet;

filling the reservoir with stored liquid; and tensioning the sheet to prevent the formation of wrinkles on the sheet.

* * * * *